US008035948B2

(12) United States Patent
Onezawa et al.

(10) Patent No.: US 8,035,948 B2
(45) Date of Patent: Oct. 11, 2011

(54) STATIC ELIMINATOR AND ELECTRIC DISCHARGE MODULE

(75) Inventors: Kazuyoshi Onezawa, Tokyo (JP); Yoshinari Fukada, Tokyo (JP); Yosuke Enomoto, Tokyo (JP)

(73) Assignee: Koganei Corporation, Tokyo (JP)

( * ) Notice: Subject to any disclaimer, the term of this patent is extended or adjusted under 35 U.S.C. 154(b) by 273 days.

(21) Appl. No.: 12/296,123

(22) PCT Filed: Apr. 11, 2007

(86) PCT No.: PCT/JP2007/057991

§ 371 (c)(1),
(2), (4) Date: Oct. 6, 2008

(87) PCT Pub. No.: WO2007/119751

PCT Pub. Date: Oct. 25, 2007

(65) Prior Publication Data

US 2009/0116162 A1 May 7, 2009

(30) Foreign Application Priority Data

Apr. 13, 2006 (JP) ..... 2006-110518

(51) Int. Cl.
*H05F 3/00* (2006.01)

(52) U.S. Cl. ..... 361/220

(58) Field of Classification Search ..... 361/220, 361/212

See application file for complete search history.

(56) References Cited

U.S. PATENT DOCUMENTS

| | | | | |
|---|---|---|---|---|
| 5,153,811 | A * | 10/1992 | Rodrigo et al. | 361/231 |
| 5,950,424 | A | 9/1999 | Nojima | |
| 2008/0190294 | A1 * | 8/2008 | Sato et al. | 96/63 |

FOREIGN PATENT DOCUMENTS

| | | |
|---|---|---|
| CN | 2660192 Y | 12/2004 |
| JP | 4-75297 | 3/1992 |
| JP | 05-047490 | 2/1993 |
| JP | 06-208898 | 7/1994 |
| JP | 9-112246 | 4/1997 |
| JP | 2003-123938 | 4/2003 |

(Continued)

OTHER PUBLICATIONS

Office Action from corresponding Korean patent application dated Jun. 17, 2010.

(Continued)

*Primary Examiner* — Rexford Barnie
*Assistant Examiner* — Angela Brooks
(74) *Attorney, Agent, or Firm* — McCormick, Paulding & Huber LLP

(57) ABSTRACT

This static eliminator is used for eliminating static electricity from an object by ionizing the air to be blown to a charged object, and has a case 12 body provided with an air blow duct 15 for blowing out an ionized air, and an electric discharge module 27 being mounted detachably on the case body 12. The electric discharge module 27 has an electric discharge needle substrate 31 having a plurality of electric discharge needles 38 arranged straightly, and a surface panel 32 detachably mounted on the case body, and the electric discharge module 27 is mounted on the case body 12 by mean of a mounting screw member 36 in the portion of the surface panel 12. By dismounting the electric discharge module 27 from the case body 12, the electric discharge needles can be replaced.

5 Claims, 7 Drawing Sheets

FOREIGN PATENT DOCUMENTS

| | | | |
|---|---|---|---|
| JP | 2004-253192 | | 9/2004 |
| JP | 2004253193 | A | 9/2004 |
| JP | 2006059612 | A | 3/2006 |

OTHER PUBLICATIONS

International Search Report for PCT/JP2007/057991.

Japanese Notification of Reasons for Refusal dated Feb. 24, 2011 corresponding to the above-identified case.

Japanese Office Action dated Nov. 2, 2010 corresponding to the above-identified case.

Chinese Office Action dated Feb. 18, 2011 corresponding to the above-identified case.

* cited by examiner

STATIC ELIMINATOR AND ELECTRIC DISCHARGE MODULE

TECHNICAL FIELD

The present invention relates to a static eliminator for eliminating static electricity from electrostatically charged electronic components or other objects, and an electric discharge module.

BACKGROUND ART

When manufacturing or assembling an electronic component, if a tool used for manufacturing or assembling an electronic component is charged with a static electricity, foreign matter such as dust may stick to the electronic component, and a defective product may be produced, or the electronic components in the transfer process may attract and contact with each other, and may not be transferred smoothly. Accordingly, by using a static eliminator known as ionizer or ion generator, the electrostatically charged portions or components are treated by blowing an ionized air. To ionize the air by an electric energy, a high voltage is applied to a needle-like discharge electrode, a non-uniform electric field is generated around the discharge electrode, and a corona discharge is generated in the area of the non-uniform electric field, and the surrounding air is ionized by the corona discharge. When a positive high voltage is applied to the discharge electrode, electrons in the air near the electrode are absorbed, and the air becomes ions having a positive electric charge, or when a negative high voltage is applied, electrons are released, and the air becomes ions having a negative electric charge.

When an alternating-current high voltage is applied to the discharge electrode, the positive and the negative air ions are generated basically by the same quantity, and when they are blown to a charged object, the object rejects ions of same polarity, and absorbs ions of opposite polarity. Accordingly, the ions of opposite polarity contact with the object, and the charged amount decreases gradually, and the positive and the negative ions of same amount contact with each other, and thereby the object is balanced and neutralized at a low potential.

Such static eliminator is described, for example, in Patent Document 1, which relates to a so-called fan type, the air blown to the object by a fan is ionized by a discharge electrode.

Patent Document 1: Japanese Patent Application Laid-Open Publication No. 2004-253192

DISCLOSURE OF THE INVENTION

When air is ionized by corona discharge, an insulating material such as foreign matter educed from the air stick to the leading end of the discharge electrode, and it is needed to remove them periodically, and further if the leading end of the discharge electrode is worn or degraded, the discharge electrode must be replaced. The static eliminator disclosed in Patent Document 1 is a static eliminator composed of a frame-shaped detachable unit having a high-voltage supply unit forming a circular hole for mounting a plurality of discharge electrodes oppositely to each other, and a main body case incorporating a fan and the detachable unit, in which the detachable unit is replaced when the discharge electrodes are worn out. In the detachable unit, the discharge electrodes are mounted oppositely to each other in the inner circumference of the circular hole allowing an air flow, toward the center of the circular hole, and in order to ensure the air flow of ionized air, the inside diameter of the circular hole must be increased, and hence the detachable unit must be increased in size.

However, to replace the worn discharge electrodes with new discharge electrodes, the large-sized detachable unit must be replaced, and the detachable unit is discarded together with the high-voltage supply unit, and since the usable high-voltage supply unit is discarded at the same time, and the maintenance cost of the static eliminator for ensuring normal ion generation is increased. Still worse, a detaching direction of the detachable unit from the main body case is at right angle to the air flow, and a drawing space for the detachable unit is needed in the dismounting area of the detachable unit, and not only the installation place of the static eliminator is limited, but also the maintenance work is difficult.

It is hence an object of the present invention to realize replacement of electric discharge needles in the static eliminator, and to enhance the maintainability of the device.

A static eliminator according to the present invention is a device for eliminating static electricity from an object by blowing an ionized air to a charged object, comprising: a case body having an air blow side, and provided with an air blow duct being opened at the air blow side for blowing out an ionized air, an electric discharge module having an electric discharge needle substrate extended in a lateral direction to the blow direction of the blow duct, being mounted detachably on the case body, and a plurality of electric discharge needles mounted on the electric discharge needle substrate at intervals, and projecting into the blow duct, in which the electric discharge module is detachably mounted on the case body from the air blow side.

The static eliminator according to the present invention is such that slits for guiding the respective electric discharge needles are formed in the blow duct, when attaching and detaching the electric discharge module to and from the case body.

The static eliminator according to the present invention is such that the plurality of electric discharge needles are mounted substantially straightly on the electric discharge needle substrate.

The static eliminator according to the present invention is such that the electric discharge module has the electric discharge needle substrate and a surface panel detachably mounted on the air blow side, and the substrate insert opening formed in the air blow side of the case body is covered with the surface panel.

An electric discharge module according to the present invention is a module having mutually parallel two longer sides, and shorter sides connecting the both ends of the both longer sides, being detachably mounted on a case body provided with the blow ducts forming rectangular air blow openings, for ionizing the air flowing in the blow ducts, comprising: an electric discharge needle substrate having a plurality of electric discharge needles being opposite to respective counter electrodes provided in the blow duct, and inserted into the slits formed in the blow duct provided at predetermined intervals, and inserted into a substrate insert opening formed in the case body, and a surface panel mounted on the electric discharge needle substrate for covering the substrate insert opening.

According to the present invention, in a case body having a blow duct for blowing out an ionized air, an electric discharge module having an electric discharge needle substrate provided with a plurality of electric discharge needles is detachably mounted, and by dismounting the electric discharge module, the electric discharge needles may be easily cleaned or the electric discharge needles may be replaced. As a result, the maintainability of the static eliminator is enhanced.

Slits for inserting the electric discharge needles are formed in the blow duct, and when assembling the electric discharge module in the blow duct, the position of the electric discharge module to the blow duct can be positioned.

BRIEF DESCRIPTIONS OF THE DRAWINGS

BEST MODE FOR CARRYING OUT THE INVENTION

Figure 1:
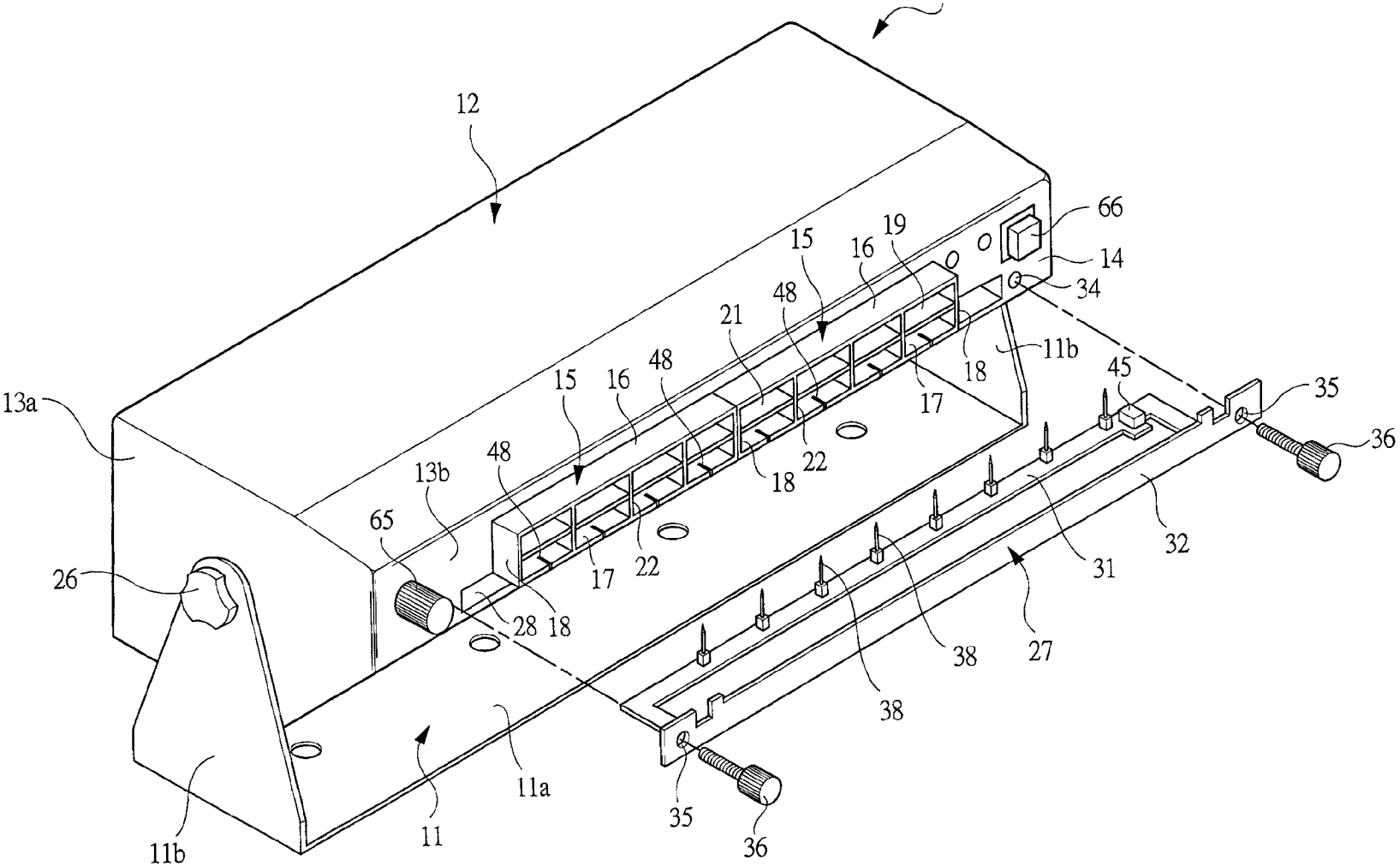
FIG. 1 is a perspective view showing an outline of a static eliminator in an embodiment of the present invention in which an electric discharge module is dismounted.

An embodiment of the present invention is specifically described below while referring to the accompanying drawings. As shown in FIG. 1, this static eliminator 10 has a holder 11 and a case body 12. The holder 11 includes a base part 11*a*, and a support part 11*b* formed integrally at both ends of the base part 11*a*, substantially at right angle to the base part 11*a*, and is formed by bending a metal plate. The case body 12 is formed of resin or metal material, and is formed like a box on the whole. Both end walls 13*a* of the case body 12 are rotatably supported to the support part 11*b*, and the outer side of a sidewall 13*b* substantially at right angle to the end wall 13*a* is formed as an air blow or discharge side 14. The sidewall 13*b* has a blow duct 15 for blowing out an ionized air being opened toward the air blow side 14, and a part of the blow duct 15 projects outward from the air blow side 14.

The case body 12 is provided with two blow ducts 15, and each blow duct 15 has longer sides 16, 17 extending in the longitudinal direction of the case body 12, and shorter sides 18 integral at both ends of the longer sides 16,17, and an air passage is formed inside. The cross section of the blow duct 15 is rectangular, and a blow opening or exit 19 at its leading end is rectangular as shown in the drawing. The blow opening 19 is divided into plural portions by a partition 21 parallel to the longer sides 16, 17, and a plurality of partitions 22 at right angle to this partition 21, and the air flowing in the blow opening 19 is straightened and discharged outside. Each blow duct 15 is divided into eight portions in two rows of four portions by the partitions 21, 22, and the blow ducts 15 are divided into a total of sixteen portions. At a substantially right angle to the sidewall 13*b*, a sidewall 13*d* connects with the sidewall 13*b* by way of a taper part 13*c* is mounted on an air feed grill 23 having a plurality of air feed openings by means of a mounting screw member 24.

Figure 2:
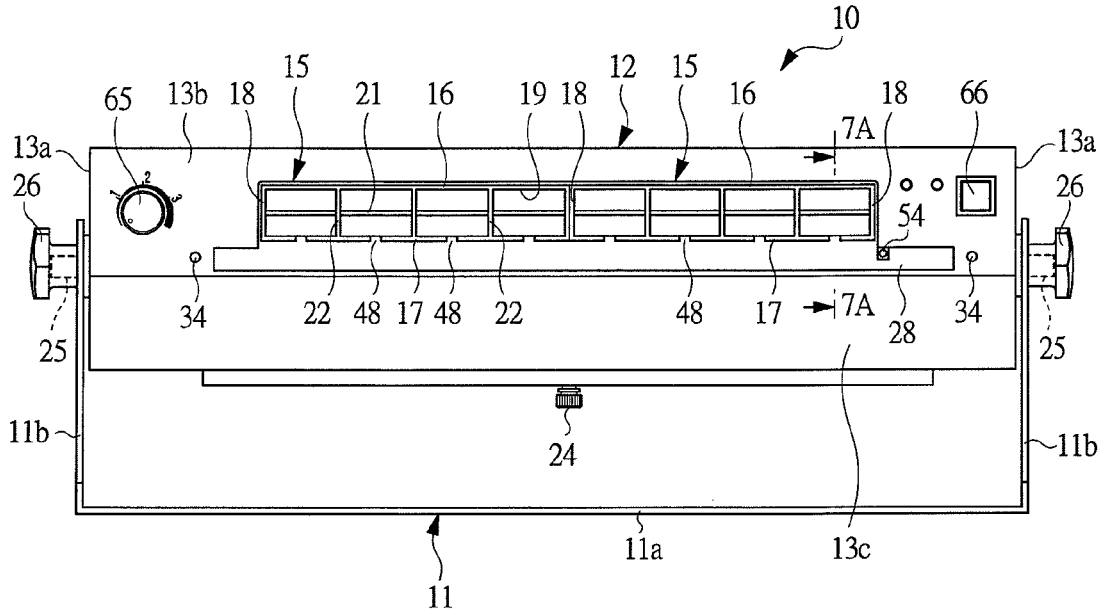
FIG. 2 is a front view of the static eliminator shown in FIG. 1.
Figure 3:
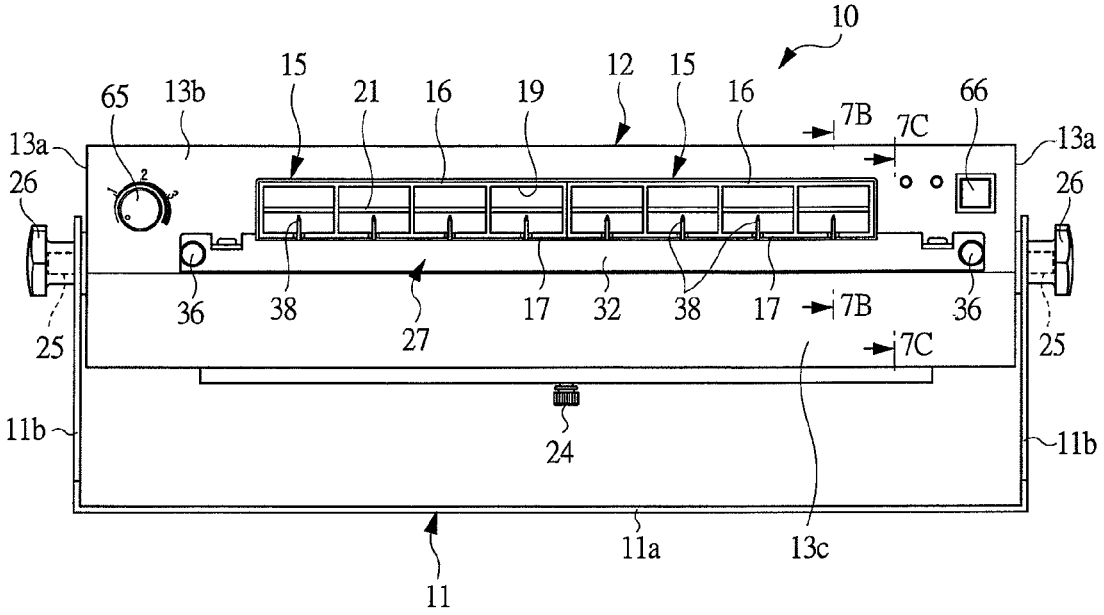
FIG. 3 is a front view of the static eliminator in which the electric discharge module is mounted.
Figure 4:
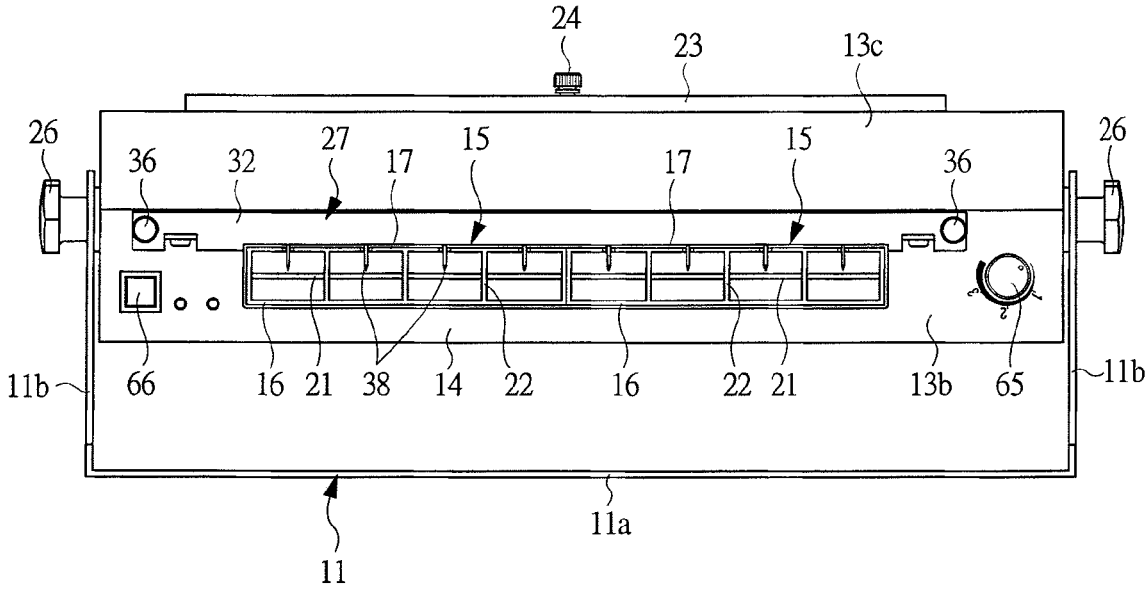
FIG. 4 is a rear view of the static eliminator in which a case body is rotated by 180 degrees.
Figure 5:
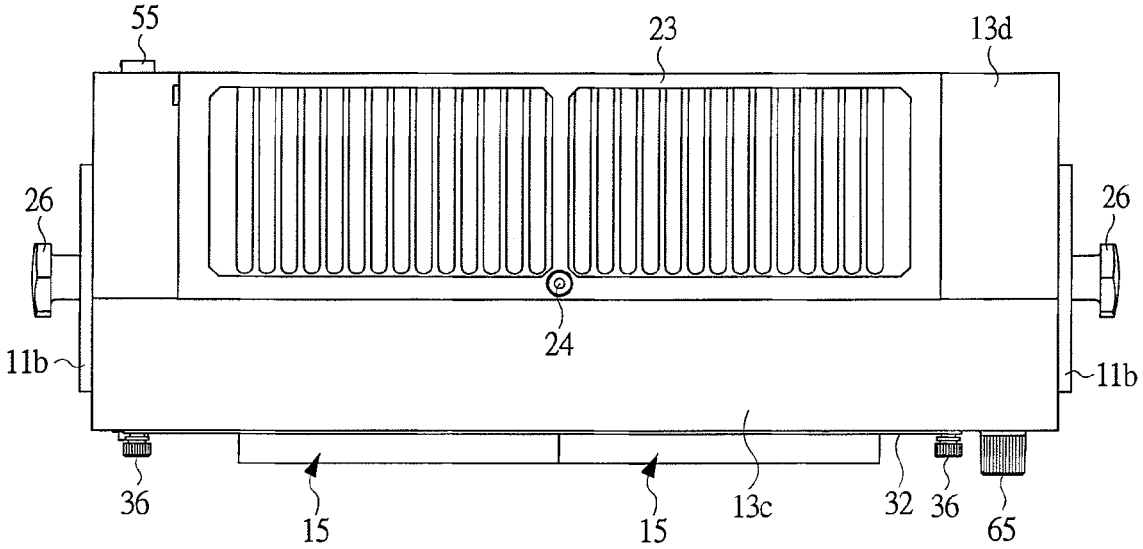
FIG. 5 is a plan view of FIG. 4.

The case body 12 is rotatably supported on the holder 11 as mentioned above. FIG. 1 shows the blow duct 15 coming to the front side, and when the case body 12 is rotated by 90 degrees in the counterclockwise direction in FIG. 1, the blow duct 15 comes to the upper side in FIG. 1, and when rotated further by 90 degrees, the blow duct 15 comes to the rear side. FIG. 4 shows the case body 12 rotated by 180 degrees from the state shown in FIG. 1. At this time, the air feed grill 23 is directed upward as shown in FIG. 4 and FIG. 5. Thus, by rotating the case body 12, the air flow direction blown out from the blow duct 15 can be changed. To tighten the case body 12 to the holder 11, as shown in FIG. 2 and FIG. 3, knobs 26 is screwed into screw shafts 25 provided at the both sidewalls 13*a* of the case body 12 and penetrating through the support part 11*b* of the holder 11, and by rotating the knobs 26 after adjusting the direction of the blow dust 15, the case body 12 is tightened to the holder 11. The holder 11 may be mounted not only on a horizontal plane, but also on a vertical plane or any mounting plane of any angle.

Figure 6:
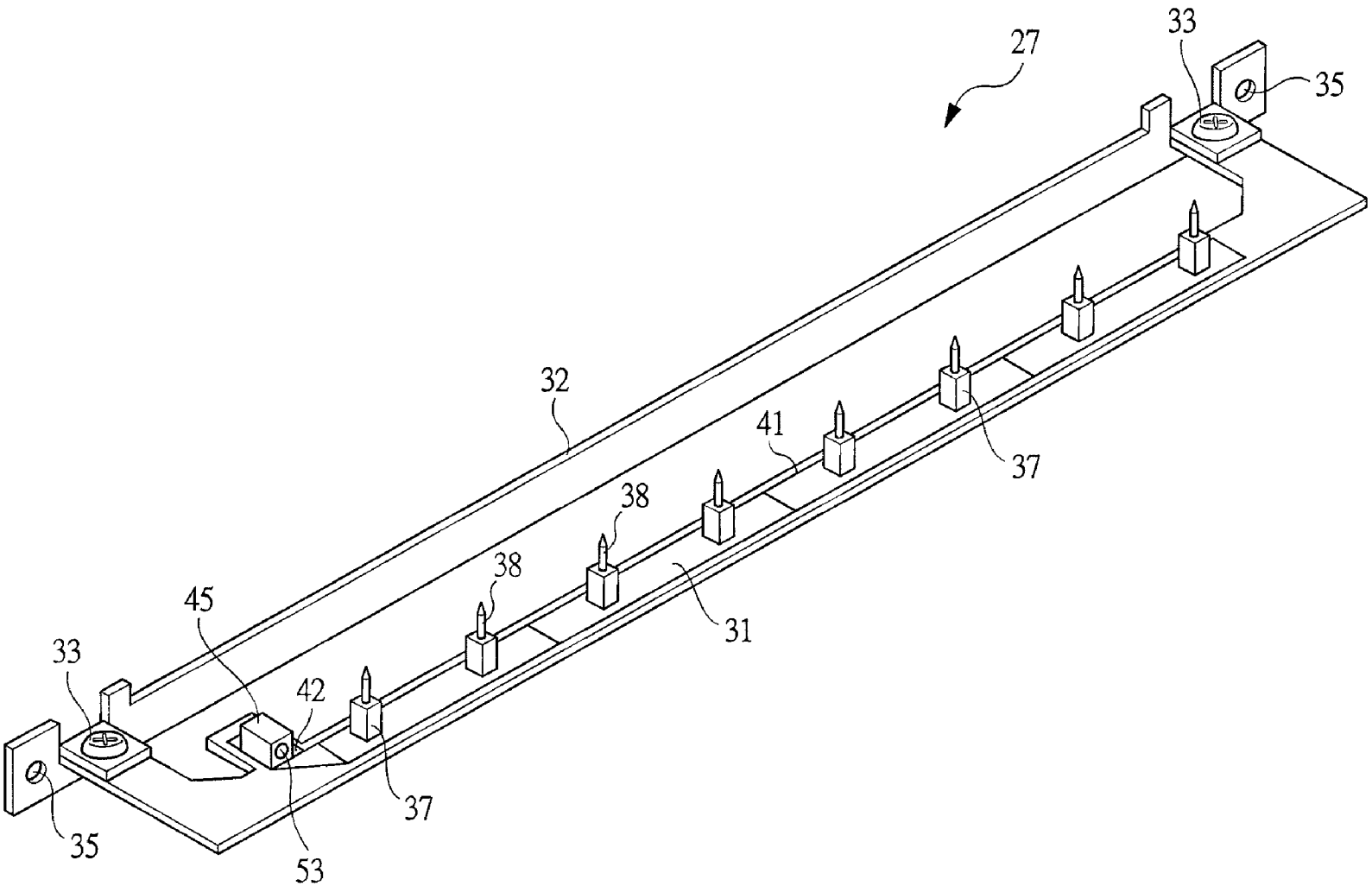
FIG. 6 is a perspective view of the electric discharge module shown in FIG. 1 as seen from the inside.

As shown in FIG. 1, an electric discharge module 27 is detachably mounted on the case body 12. The electric discharge module 27 includes an electric discharge needle substrate 31 inserted into a substrate insert opening 28 formed adjacently to the blow duct 15 on the air blow side 14 of the case body 12, and a surface panel 32 screwed to the air blow side 14, and the surface panel 32 is fixed to the electric discharge needle substrate 31 by means of a threaded member 33 as shown in FIG. 6. To mount the electric discharge module 27 detachably on the case body 12, a mounting screw member 36 penetrating a through-hole 35 formed in the surface panel 32 is screwed into a mounting thread 34 formed in the air blow side 14.

The electric discharge needle substrate 31 is formed of a band-shaped resin plate material, and eight fixing pieces 37 made of copper or other metal material are mounted at specific intervals substantially straight in its longitudinal direction, and electric discharge needles 38 made of metal material are fixed to each fixing piece 37. On the surface of the electric discharge needle substrate 31, a printed wiring 41 is provided for connecting electrically to the electric discharge needles 38 arrayed straightly, and the printed wiring 41 is connected to a conductive end 42, and a connection terminal 45 of copper or other metal material is mounted to this conductive part 42. The number of electric discharge needles 38 provided on the electric discharge needle substrate 31 is not limited to eight, but may be optional number, for example, twelve, depending on the longitudinal dimension size of the blow opening 19.

The blow duct 15 is formed in a rectangular shape consisting of the longer sides 16, 17, and the shorter side 18 integral to the both ends thereof, and since the blow opening 19 is rectangular, the length of the blow duct 15 may be an optional length, or an optional number of the blow ducts 15 may be mounted on the case body 12, so that the blow air flow may be optionally set. The interval of electric discharge needles 38 may be also set at any pitch freely, depending on the ion density, the width of the blow ducts 15.

Figure 7A:
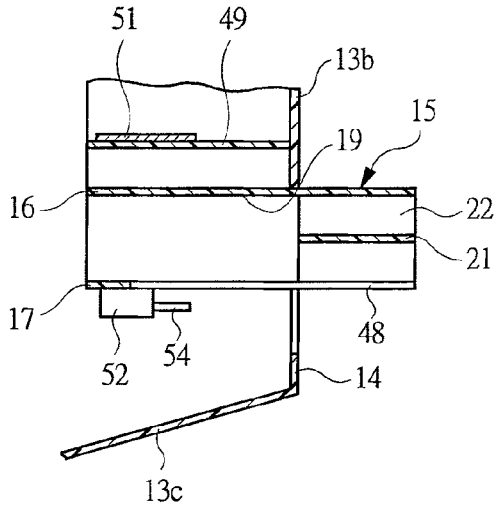
FIG. 7A is a magnified sectional view along line 7A-7A in FIG. 2.
Figure 7B:
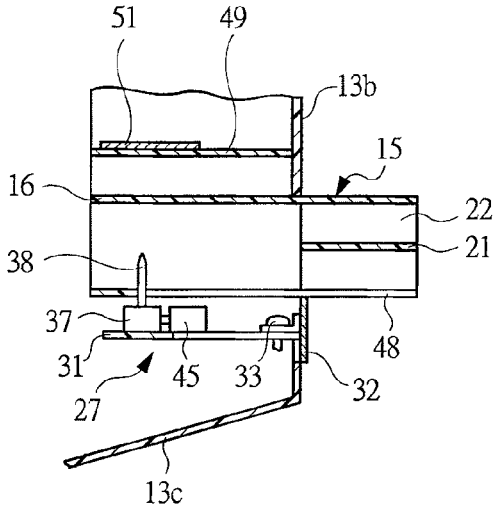
FIG. 7B is a magnified sectional view along line 7B-7B in FIG. 3.
Figure 7C:
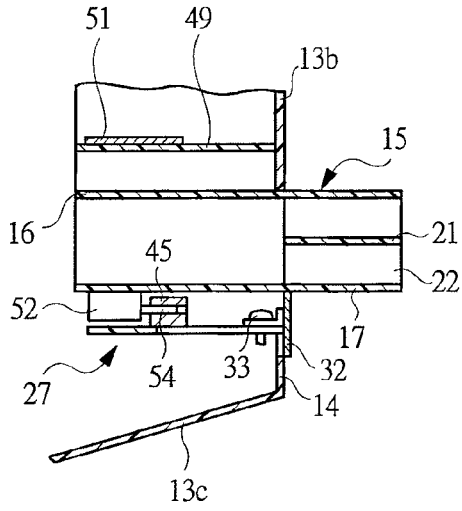
FIG. 7C is a magnified sectional view along line 7C-7C in FIG. 3.

FIG. 7A is a magnified sectional view along line 7A-7A in FIG. 2, FIG. 7B is a magnified sectional view along line 7B-7B in FIG. 3, and FIG. 7C is a magnified sectional view along line 7C-7C in FIG. 3.

As shown in FIGS. 7A, 7B, and 7C, slits 48 are formed corresponding to the electric discharge needles 38 at the longer side 17 of the blow duct 15, and each slit 48 extends from the opening end side of the blow dust 15 toward the opposite end, and when attaching and detaching the electric discharge module 27 on and from the case body 12, that is, when mounting the electric discharge module 27 on the case body 12 and when dismounting from the case body 12, the electric discharge needles 38 are guided into the slits 48 respectively. When the electric discharge module 27 is mounted on the case body 12, each electric discharge needle 38 projects into the blow duct 15 as shown in FIG. 7B. To be opposite to all electric discharge needles 38, counter electrodes 51 are mounted in a support part 49 extended parallel to the longer side 16 of the blow duct 15 as shown in FIGS. 7 A, 7B, and 7C.

On the outer side of the longer side 17 of the blow duct 15, as shown in FIG. 7A, a support piece 52 is fixed, and a pin 54 fitted to a connection hole 53 formed in the connection terminal 45 is mounted to this support piece 52 as a connection terminal. Therefore, when the electric discharge module 27 is mounted on the case body 12, the pin 54 is inserted into the connection hole 53 of the connection terminal 45 provided in the electric discharge needle substrate 31, and each electric discharge needle 38 electrically connected to the pins 54. The blow duct 15 may be provided with a connection terminal having a connection hole, and the electric discharge module 27 may be provided with a pin-shaped connection terminal.

Figure 8:
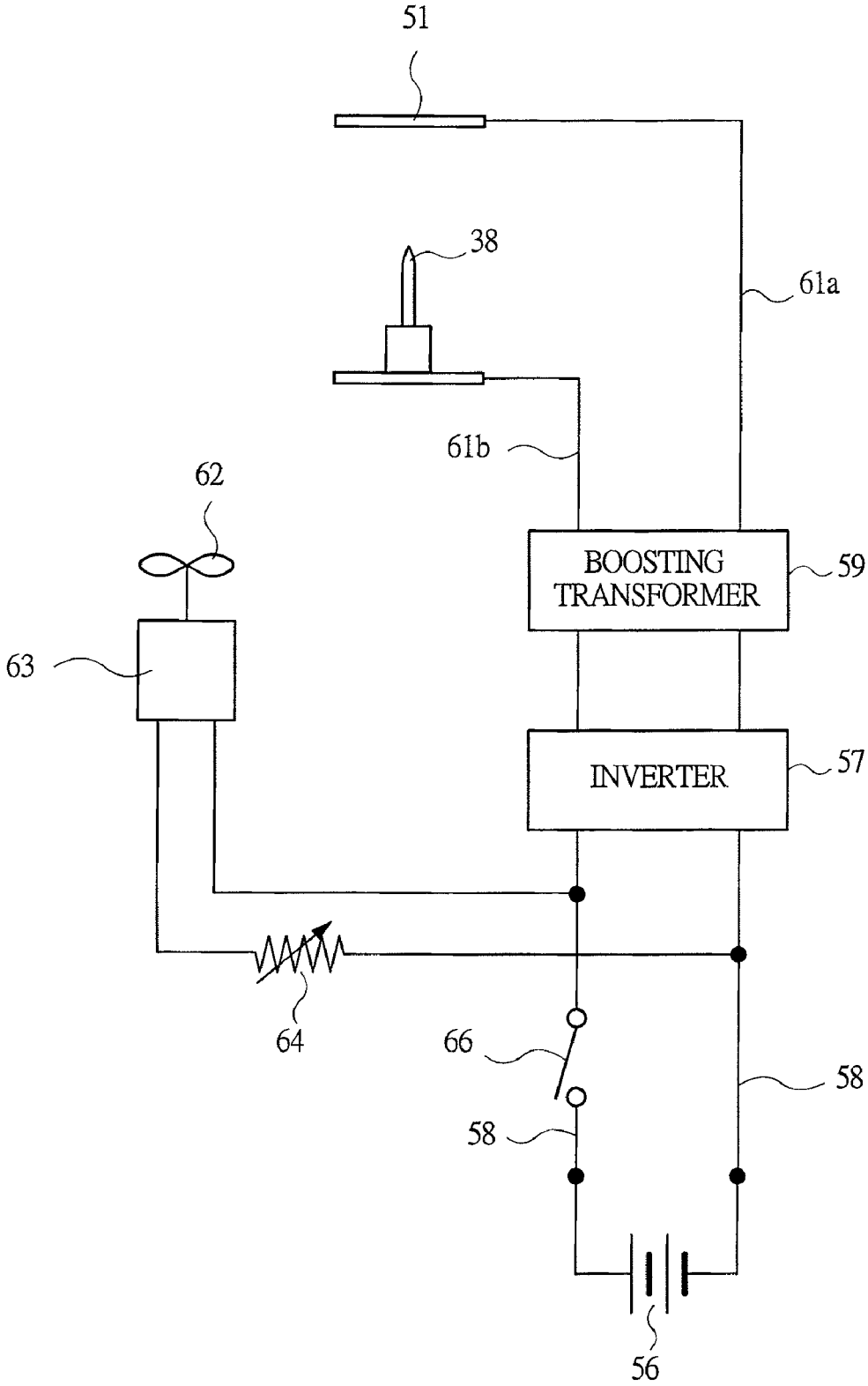
FIG. 8 is a schematic diagram showing a power feeding circuit of the static eliminator.

FIG. 8 is a schematic diagram showing a power feeding circuit of the static eliminator 10. As shown in FIG. 5, a direct-current power supply 56 of, for example, 24 V is connected to a connector 55 provided in the case body 12. An inverter 57 for inverting a direct current into a high frequency is provided in the case body 12, and the inverter 57 is connected to the direct-current power supply 56 by way of a power feeding cable 58 connected to the connector 55. The electric power inverted to a high frequency of, for example, about 68 kHz by the inverter 57 is boosted by a step up transformer 59 to, for example, 2 kV. An output line 61*a* of the step up transformer 59 is directly connected to the counter electrode 51, and an output line 61*b* is connected to each electric discharge needle 38 by way of the connection terminal 45.

The case body 12 is provided with a fan 62 for introducing external air from the air feed grill 23, and blowing out the introduced air toward the blow duct 15, and a direct current is supplied to a direct-current motor 63 for driving the fan 62 through the power feeding cable 58. The power feeding cable 58 is provided with a variable resistor 64 for adjusting the motor rotating speed, and this variable resistor 64 is manipulated by an adjusting dial 65 provided on the air blow side 14 of the case body 12 as shown in FIG. 2 and FIG. 3. The power feeding cable 58 is turned on or off by a main switch 66, and this main switch 66 is provided on the air blow side 14 of the case body 12.

By using the above-mentioned static eliminator, in order to eliminate static electricity from the object by blowing an ionized air to the object such as an electronic component, as shown in FIG. 3, the electric discharge module 27 is mounted on the case body 12, and the opening of the blow duct 15 is directed toward the object. By operating the main switch 66, the fan 62 is driven by the motor 63, and external air is introduced into the case body 12 from the air feed opening in the air feed grill 23, and is supplied into the blow duct 15.

A high voltage of specified frequency is applied to the electric discharge needles 38 and counter electrodes 51 from the step up transformer 59, and a corona discharge is generated around the electric discharge needles 38. As a result, the air flowing into the blow duct 15 is blown into an ionized air containing the positive ions and the negative ions, and is blown to the object, and the charged object is neutralized by the ionized air. The ionized air is straightened by the partitions 21, 22 provided in the blow duct 15, and the ions are uniformly dispersed generally from the blow opening 19 of the blow duct 15, and are blown to the object.

When foreign matter is educed or sticks on the electric discharge needles 38, the mounting screw member 36 is loosened as shown in FIG. 1, and the electric discharge module 27 is dismounted from the case body 12, and the electric discharge needles 38 are cleaned. Thus, the electric discharge module 27 can be easily dismounted from the air blow side 14 of the case body 12, and the electric discharge needles 38 can be cleaned easily. If the electric discharge needles 38 are degraded, similarly, the electric discharge module 27 can be dismounted from the case body 12, and can be replaced with a new electric discharge module, and the working is easily done.

Figure 9:
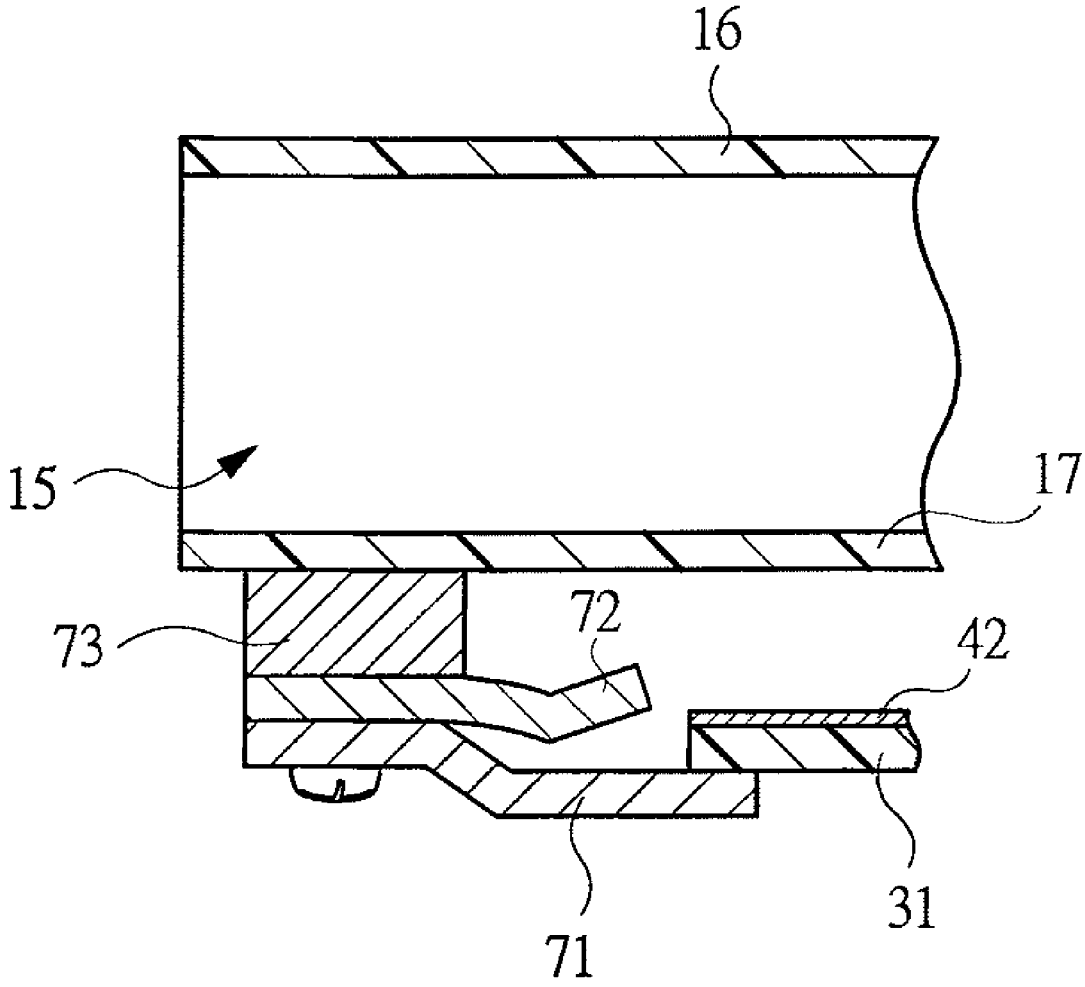
FIG. 9 is a sectional view showing a modification of connection terminals provided in a blow duct.

FIG. 9 is a sectional view showing a modified example of a connection terminal provided in the blow duct 15 of the case body 12. In this case, the connection terminal 45 forming the connection hole 53 is not provided on the electric discharge needle substrate 31, but the conductive end 42 printed on the electric discharge needle substrate 31 is used as the substrate side connection terminal. Corresponding to this connection terminal, the blow duct 15 is provided with a connection terminal formed of a terminal piece 71 contacting with the reverse side of the electric discharge needle substrate 31, and a terminal piece 72 contacting with the conductive end 42 at the surface side of the electric discharge needle substrate 31 is fixed thereto, by way of a spacer 73. Thus, the electric connection between the electric discharge needles 38 of the electric discharge module 27 and the power supply at the case body 12 side is not limited to the illustrated example, but may be realized in various modes.

Alternatively, a step up transformer 59 may be mounted to the electric discharge needle substrate 31. In this case, by shortening the distance between the step up transformer 59 and the electric discharge needles 38, the impedance between them can be reduced, and hence the electric power loss can be decreased.

The present invention is not limited to the above embodiment, and may be variously modified and varied within the scope of not deviating from the gist thereof. For example, a direct current may be supplied individually to the counter electrodes 51 and electric discharge needles 38. The present invention may be applied also as an ozonizer for applying ozone to the air by corona discharge. Further, without assembling the fan 62 and the motor 63 in the case body 12, air may be supplied from outside of the case body 12. In the shown example, in the electric discharge needle substrate 31, a plurality of electric discharge needles 38 are arrayed in a row, but may be arrayed in plural rows, or may be formed in a zigzag layout instead of a straight layout.

INDUSTRIAL APPLICABILITY

The present invention is applied for eliminating static electricity from charged tools used in manufacture and assembling of electronic components.

The invention claimed is:

1. A static eliminator for eliminating static electricity from a charged object by blowing an ionized air onto the charged object, the static eliminator comprising:

a case body having an air discharge side, and provided with an air blowing duct being open and having an exit at the air discharge side for blowing an ionized air out of the case body and toward the charged object;

a substrate insert opening formed adjacent to the air blowing duct on the air discharge side of the case body;

an electric discharge module having an electric discharge needle substrate extending in a lateral direction to the blow direction of the air blowing duct and dimensioned to be removably inserted into the substrate insert opening, and a plurality of electric discharge needles mounted on the electric discharge needle substrate at intervals projecting into the air blowing duct at the exit, wherein the electric discharge module is detachably mounted on the case body from the air discharge side, and when the electric discharge module is mounted on the case body, the electric discharge needles are disposed opposite to counter electrodes in the case body.

2. The static eliminator according to claim 1, wherein the air blowing duct at the air discharge side is formed in a rectangular shape by two mutually parallel longer sides, and shorter sides connecting the ends of the longer sides, and the air blowing duct defining slits in one of the longer sides adjacent to the substrate insert opening, the slits being dimensioned to correspond to the electric discharge needles for guiding the respective electric discharge needles into position.

3. The static eliminator according to claim 1, wherein the plurality of electric discharge needles are mounted along a substantially straight line on the electric discharge needle substrate.

4. The static eliminator according to claim 1, wherein the electric discharge module further includes a surface panel mounted on the electric discharge needle substrate and detachably mounted on the air discharge side of the case body, and the substrate insert opening is substantially covered by the surface panel when the electric discharge module is mounted to the case body.

5. An electric discharge module for detachable mounting on a case body provided with an air blowing duct having a rectangular exit and ionizing air flowing in the air blowing duct, the rectangular exit having two mutually parallel longer sides and two mutually parallel shorter sides connecting each end of the longer sides, the air blowing duct being provided with counter electrodes along one of the longer sides and slits formed at predetermined intervals along the other of the longer sides, the case body having a substrate insert opening formed in the case body adjacent to the longer side of the air blowing duct with the slits; the electric discharge module comprising:

an electric discharge needle substrate having a plurality of electric discharge needles extending perpendicularly from the electric discharge needle substrate, the electric discharged needles being spaced from each other at substantially the same intervals as the slits in the air blowing duct, the electric discharge needle substrate being dimensioned to be removably inserted into the substrate insert opening formed in the case body, and a surface panel mounted to the electric discharge needle substrate, the surface panel being dimensioned to substantially cover the substrate insert opening.

* * * * *